US005125128A

United States Patent [19]

Davis

[11] Patent Number: 5,125,128

[45] Date of Patent: Jun. 30, 1992

[54] STREET SWEEPING MACHINE

[76] Inventor: Henry J. Davis, c/o A-D Machinery Co./Terravac, 1025 E. Oak St., Stockton, Calif. 95205

[21] Appl. No.: 557,125

[22] Filed: Jul. 23, 1990

[51] Int. Cl.[5] ..... E01H 1/08

[52] U.S. Cl. ..... 15/340.4; 15/340.1; 15/354; 15/418

[58] Field of Search ..... 15/340.1, 340.3, 340.4, 15/354

[56] References Cited

U.S. PATENT DOCUMENTS

| | | | |
|---|---|---|---|
| 1,069,608 | 8/1913 | Ewing et al. | 15/340.4 |
| 1,452,307 | 4/1923 | Martin | 15/87 |
| 3,605,170 | 9/1971 | Hank et al. | 15/340.3 X |
| 3,636,585 | 1/1972 | Larsen | 15/340.3 X |
| 3,837,038 | 9/1974 | Kimzey et al. | 15/340.3 X |
| 3,881,215 | 5/1975 | Krier et al. | 15/340.1 |
| 3,886,623 | 6/1975 | Landesman et al. | 15/340.3 X |
| 3,942,214 | 3/1976 | Maasberg | 15/340.1 X |
| 3,984,894 | 10/1976 | Brock et al. | 15/340.3 X |
| 4,110,864 | 9/1978 | Gunnarsson | 15/346 |

FOREIGN PATENT DOCUMENTS

| | | | |
|---|---|---|---|
| 1096941 | 1/1961 | Fed. Rep. of Germany | 15/340.3 |

*Primary Examiner*—Chris K. Moore
*Attorney, Agent, or Firm*—Julian Caplan

[57] ABSTRACT

A street sweeping machine is incorporated in an industrial vacuum machine. Extending transversely of the vehicle is a center casing in which a brush is rotated by a hydraulic motor. A vacuum intake hose is connected to the casing and leads to the vacuum machine. The casing may be raised and lowered between transport and working positions. On one or both sides of the vehicle are side or "curb sweeping" casings, likewise containing a hydraulically driven brush and connected to a vacuum intake hose. The curb sweeping casing is swivel mounted and spring biased outward to follow the curb on the street being swept. In the main centered casing are a hydraulically raised and lowered flap which improves the vacuum which can be drawn in the casing. Also provided is a stick breaker which breaks up large pieces of debris so that they may be drawn into the vacuum duct.

13 Claims, 3 Drawing Sheets

STREET SWEEPING MACHINE

BACKGROUND OF THE INVENTION

1. Field of the Invention

This invention relates to a new and improved street sweeping machine characterized in that a pick-up casing travels over the street and is hose-connected to an industrial-type vacuum machine.

2. Description of Related Art

U.S. Pat. Nos. 3,651,621 and 4,150,913 show vehicle mounted industrial vacuum machines useful in extracting dirt from holes, cleaning industrial plants, sewer catch basins, railroad cars, sandblasted areas and other places and also in cleaning streets and highways. The present invention is a machine which is used in conjunction with such a vacuum machine.

SUMMARY OF THE INVENTION

A motor driven blower is connected to a casing and draws a vacuum within the casing. A hose attached to the street sweeper mechanism picks up debris and draws the debris into baffled compartments, particularly such as those shown in U.S. Pat. No. 3,651,621 and then into a filter chamber. The machine separates out debris of various kinds, namely, heavy particles, medium particles and fines. The street sweeper mechanism of the present invention may be used with such a vacuum machine or other vacuum machines.

One feature of the present invention is the provision of a casing which extends transversely of the vehicle and, in working position, is supported by casters slightly above the surface being swept. To improve drawing vacuum, flexible flaps may be supported fore and aft to contact the ground and thus improve the effect of the vacuum drawn in the casing. One or both flaps may be hydraulically or pneumatically actuated to vary the space between the lower edge of the flap and the surface being swept. The casing is connected by a hose to the vacuum machine heretofore described.

Another feature of the invention is the provision of means to raise and lower the casing between operative and transport positions.

Still another feature of the invention is the provision of a rotating blade which breaks sticks and other large objects into smaller pieces so that they may be drawn into the hose leading to the vacuum machine.

The brush within the casing is preferably rotated by a hydraulic motor in a direction such that the bottom of the brush is rotating in a direction opposite the direction of movement of the machine thereby causing debris on the .road surface to be lifted and then drawn by vacuum into the hose. A further feature of the invention is the provision of means for adjusting the height of the brush above the ground to compensate for wear of the brush fiber.

In a modification of the invention, the casing is hinged at its center to improve ground contact when travelling crowned roadways.

Still another feature of the invention is the provision of a "curb feeler" casing which is mounted relative to the vehicle frame and is also connected to the intake of the vacuum machine. The curb feeler is supported above the ground by casters and is biased outwardly toward the curb by means of a spring. The curb feeler follows the curb as the vehicle is driven along the roadway and moves inward and outward to avoid obstructions.

The curb feeler additionally has means for raising and lowering the casing between transport and operative positions, brush height adjustment means and flaps to increase the effectiveness of vacuum similar to what has been stated above with respect to the main vacuum member.

In a modification of this invention the brush casing is formed with an opening. The hose or conduit connecting the casing to the vacuum machine is connected to surround a hole formed in a plate dimensioned to close the opening. Hence when the plate is attached to cover the opening, the hose communicates with the interior of the casing. A feature of this modification is that the plates may be made interchangeable for use of various attachments.

Thus in one variation used to pick up heavy materials, a scoop-like member is fixed to the underside of an interchangeable plate. The scoop member extends down near the ground level immediately to the rear of the rotating brush and has a restricted opening. Heavy debris is lifted off the ground by rotation of the brush and is discharged tangentially directly into the restricted opening and then drawn by vacuum through the hose and into the vacuum chamber.

In still another variation the rotating blade which breaks sticks may be mounted on the interchangeable plate along with its housing and drive motor.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
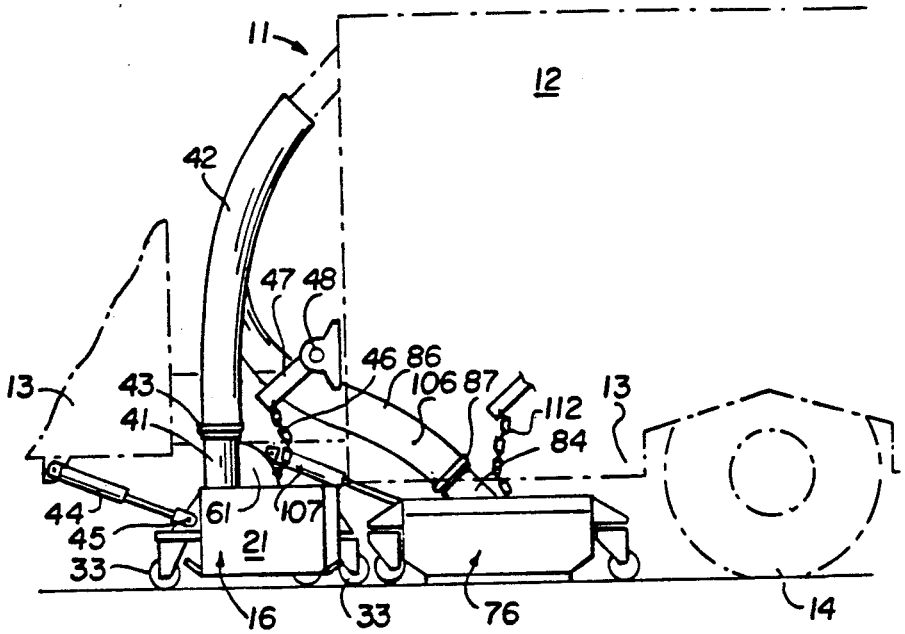
FIG. 1 is a fragmentary side elevational view of a vacuum machine on which the street sweeper mechanisms are mounted.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A vehicle mounted vacuum machine 11 similar to that shown in U.S. Pat. Nos. 3,651,621 and 4,150,913 or other suitable high vacuum, large volume industrial cleaning machines may be employed with the present invention. Machine 11 contains a housing 12 described in detail in said U.S. Pat. No. 3,651,621 mounted on a vehicle frame 13 shown partially in FIG. 1 and supported for travel over a street or other area to be swept by wheels 14.

Mounted ahead of frame 13 and extending transversely of the vehicle is a transverse pick-up head housing 16. Housing 16 has a top 17, front 18, back 19 and sides 21. The bottom is open. In the preferred form shown in FIG. 3, a rotatable brush 22 is contained within the housing 16, said brush 22 being affixed to a transverse shaft 23 rotatably mounted in support 24, fixed to side 21. A hydraulic or other motor 26 is arranged to turn shaft 23 in a clockwise direction as viewed in FIG. 3. The bottom of brush 22, therefore, turns in the direction of movement of housing 16. Motor 26 is supported by bracket 27 fixed to support 24.

With the passage of time, the bristles of brush 22 wear and, hence, it is desirable to lower the shaft 23 as the brush wears. For such purpose an adjustment screw 28 on either side of the housing 16 is threaded through a bracket 29 affixed to side 21. The lower end of screw 28 bears against bracket 27. As the screw 28 is turned downward, shaft 23 is pushed downward, there being a vertical slot (not shown) in side 21 to accommodate movement of shaft 23.

Figure 3:
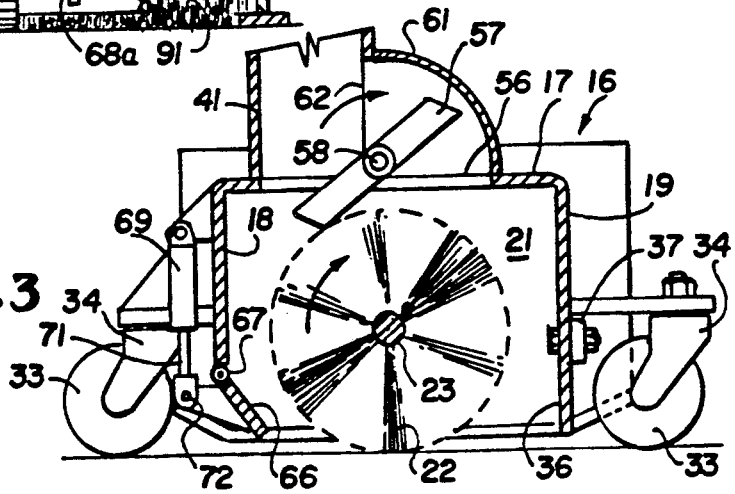
FIG. 3 is a vertical midsectional view through the pick-up head housing.
Figure 5:
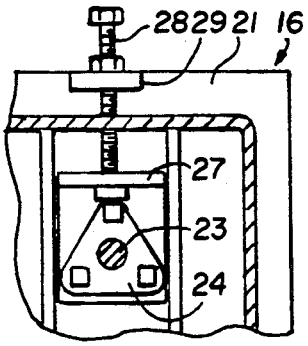
FIG. 5 is a further enlarged fragmentary view of a portion of the mechanism.

An opening 56 is formed in top 17 of casing 16 which is larger than the size of duct 41 (see FIG. 3). A breaker blade 57 is mounted on a transfer shaft 58 located above the level of top 17 immediately behind the duct 41. Shaft 58 is driven at one end by hydraulic or other motor 59. Enclosing opening 56 and attached to duct 41 is a housing 61 shaped, as best shown in FIG. 3, to enclose blade 57 as it rotates. Large sticks or other large debris which enters housing 16 is drawn upward by the vacuum drawn through duct 41 but, if it is larger than the duct 41 cannot be evacuated. Blade 57 revolves in the direction shown by the arrows in FIG. 3 and hence breaks such sticks against the abutment 62 to either side of housing 61. In order to accommodate rotation of blade 57, a gap is formed in the bristles in brush 22.

Housing 16 is supported by front and rear casters 33 on each side, each caster being connected to a portion of housing 16 by swivels 34. Attached to back 19 is flexible flap 36 which extends to hear the surface being swept and is held in position by holders 37. Flap 36 improves the efficiency of vacuum drawn within the housing 16 by reducing the area of the space through which air enters housing 16. Shown in FIG. 3 is a front flap 66, it being understood that a similar pivoted flap may be installed in the rear of the housing 16 instead of flap 36 if desired. Flap 66 is supported along its top edge by hinge 67 on the bottom of front 18. Bracket 68 is attached to the outside of flap 66 and is actuated by hydraulic or pneumatic cylinder 69 mounted on front 18. The rod 71 of cylinder 77 is attached by clevis 72 to bracket 68. Thus, by energizing cylinder 69, the flap 66 may be raised and lowered to an appropriate level above the pavement being swept. Where a large object is being approached, the cylinder 69 may be actuated to raise the flap 66 to avoid the object.

Duct 41 extends up from the top 17 and it is connected to hose 42 by means of quick disconnect clamps 43 of conventional construction. Hose 42 leads up to the housing 12 and, hence, as a vacuum is drawn in housing 12 a vacuum is drawn within the housing 16. A pair of telescopic arms 44 of the type conventionally used in vehicle steering mechanisms or other telescopic means are attached to the front edge of top 17 on either side thereof and also to the vehicle frame 13 at a convenient location. The opposite ends of arms 44 are provided with ball and socket joints 45 in the manner of such steering mechanisms.

It is desirable to raise and lower housing 16. Thus, when the housing 16 is raised, the vehicle may be more rapidly moved from place to place, whereas in its lowered position, the housing 16 is in working position. Raising and lowering is accomplished by means of chains 46 attached to top 17 and to arms 47 on shaft 48. Shaft 48 may be turned to raise and lower arm 47 and thereby raise and lower the housing 16.

Figure 6:
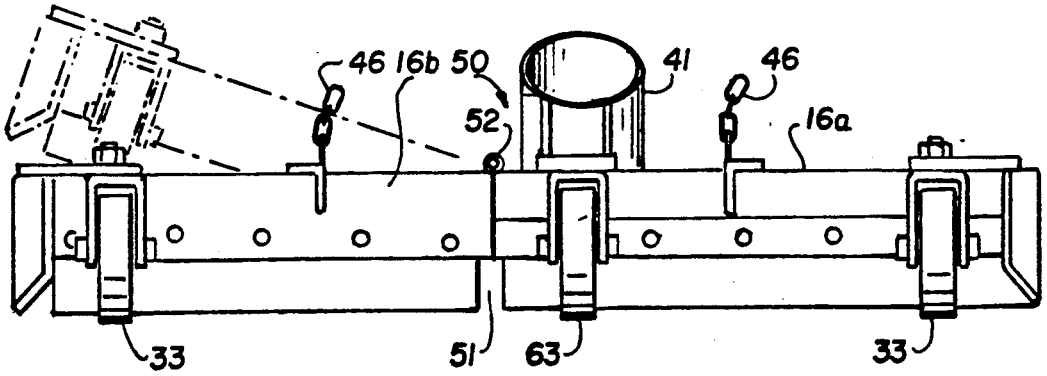
FIG. 6 is a front elevational view of a further modification.

Directing attention to the structure shown in FIG. 6, the casing 50 consists of left and right sections split as indicated by reference numeral 51 and hinged together as indicated by reference numeral 52. An additional central caster 63 is installed on one of the halves of the casing 50. The structure such as that shown in FIG. 6 is particularly suitable for crowned roadways or roadways which slope up or down at the shoulder, as is shown by dot-and-dash lines on the left side of FIG. 6. The brushes (not shown) are individually mounted in the halves **16*a* and 16*b* and are preferably separately driven by their own motors (not shown). In other respects the structure of FIG. 6 resembles that of FIG. 3** and the same reference numerals followed by subscripts a designate corresponding parts.

It is desirable to use, in addition to the transverse vacuum housing 16, a curb casing 76 on one or both sides of the machine. Curb casing 76 consists of a top 77, front 78, back 79 and sides 81. On front 78 and back 79 are flaps 82 which are flexible and extend down to near the ground and are positioned by means of holders 83. Duct 84 communicates with top 77 and is connected to hose 86 by means of clamp 87. Hose 86 extends to the vacuum machine housing 12 in the same manner as hose 42.

Figure 2:
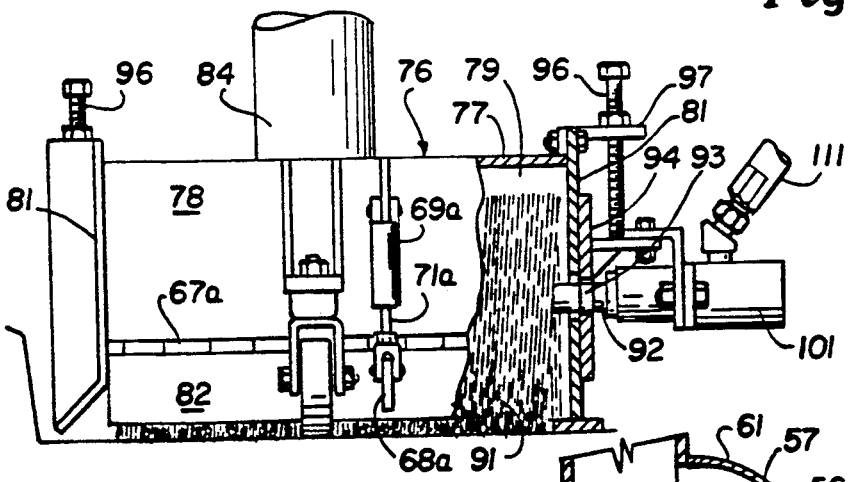
FIG. 2 is an enlarged front elevational view through the curb casing partially broken away to reveal internal construction.

Rotatable within casing 76 is a brush 91 similar to brush 22, but preferably smaller. Brush 91 is mounted on shaft 92 which is received in bearings 93 attached to holders 94 which move vertically along sides 81. As shown in FIG. 2, holders 94 slide vertically. A screw 96 is threaded into support 97 fixed to top 77. The lower end of screw 96 is rotatably received in holder 94. By turning screw 96, holder 94 and shaft 92 may be raised and lowered to accommodate wear of brush 91.

On one side of casing 76 is motor 101 which is preferably hydraulically driven and mounted on bracket 102 attached to side 66. Casters 103 on each side of the back of casing 76 and also in the center of the front are mounted on swivels 104 to the casing 76.

Casing 76 is connected to frame member 106, which is attached at a convenient location to the vehicle frame 13. The connection is preferably by means of telescopic arms 107 in the same manner as the members 44 and 45 which support housing 16. A strong spring 111 connects one corner of the casing 76 to the vehicle frame 13 in such a manner as to bias the casing 76 outwardly toward a curb. When the casing contacts the curb, it moves inwardly toward the vehicle, but the spring 111 causes it to maintain contact with the curb. Hence, in normal travel, the casing 76 moves in and out as the machine 11 travels down a roadway, generally maintaining contact with the curb and sweeping and removing dust and debris between the area which is cleaned by the housing 16 and the curb.

It is desirable that the curb casing 76 be raised and lowered between transport and working positions. One means for raising and lowering the casing is similar to that used to raise and lower housing 16. Thus, chains 112 are connected at their lower ends to top 77 and at their upper ends to arms 113 which are raised in the same manner as arms 47.

Figure 7:
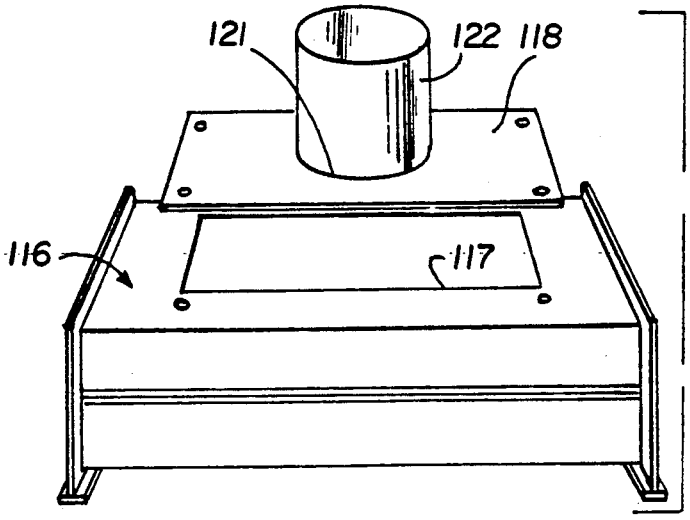
FIG. 7 is a schematic exploded perspective view of a modification with certain parts omitted.
Figure 8:
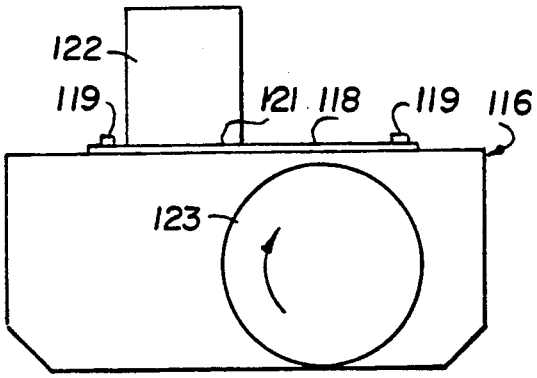
FIG. 8 is a schematic mid-sectional view of the structure of FIG. 7.

FIGS. 7 and 8 show schematically a casing 116 which may function similarly to casing 16 or casing 76 of FIG. 1 and may be similarly constructed and supported. Opening 117 is formed in the top of casing 116 and is closed by a plate 118 held in place substantially air-tight by bolts 119 or other suitable means. Plate 118 is interchangeable as is seen by comparison of FIGS. 8, 9 and 10. Thus in FIG. 8 an opening 121 is formed in plate 118 and connected to duct 122 which is coupled to a hose (not shown) leading to the vacuum machine. Brush 123 sweeps debris off the ground and it is raised by vacuum from duct 122.

Figure 9:
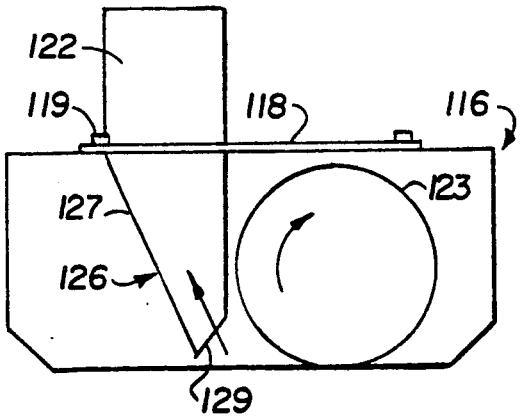
FIG. 9 is a view similar to FIG. 8 showing a modification employing a heavy material attachment.

In FIG. 9 a heavy material attachment scoop 126 is connected to the underside of interchangeable plate 118. Scoop 126 has a back extending down to near ground level behind brush 123. The front 128 extends dow to a level slightly higher than back 127 leaving an opening 129 immediately behind brush 123. Heavy debris is swept off the ground by rotation of brush 123 and flies tangentially into opening 129 whence it is lifted by vacuum.

Figure 4:
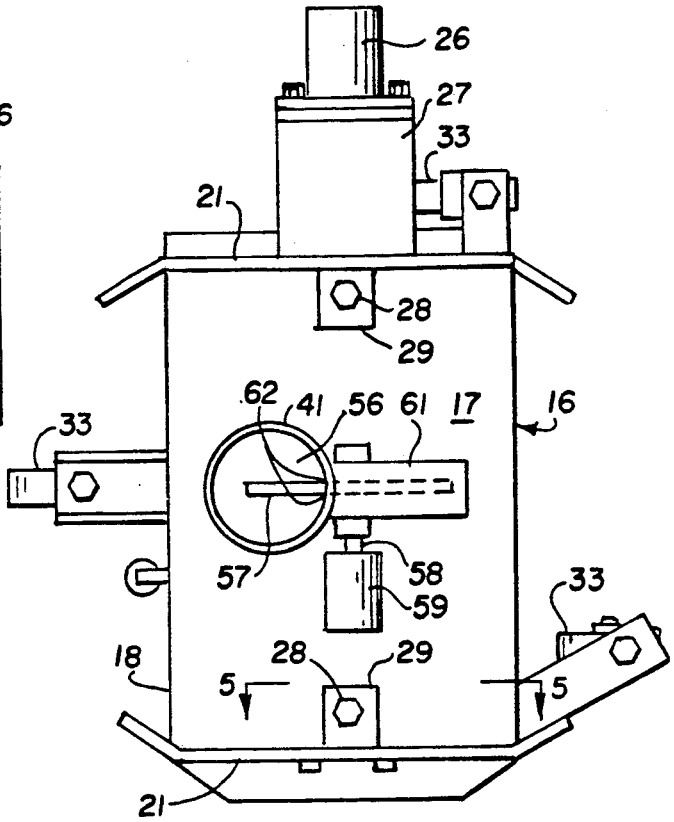
FIG. 4 is a top elevational view of the structure of FIG. 3.
Figure 10:
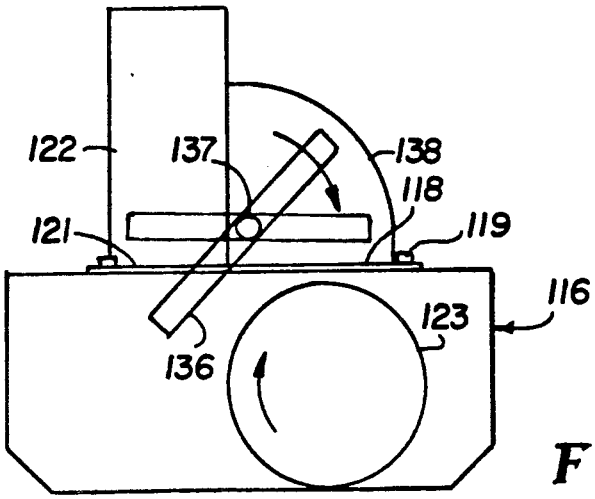
FIG. 10 is a view similar to FIG. 8 showing another modification employing a stick breaker attachment.

FIG. 10 shows a stick-breaker attachment mounted on a different interchangeable plate 118—similar to that shown in FIGS. 1, 3 and 4. Blade 136 is mounted on shaft 117 which is supported and driven by means similar to blade 57, all mounted on plate 118, as is blade housing 138.

Thus by making plates 118 interchangeable, different attachments may be rapidly and conveniently attached. The foregoing descriptions of specific embodiments of the present invention have been presented for purposes of illustration and description. They are not intended to be exhaustive or to limit the invention to the precise forms disclosed, and obviously many modification and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A street sweeping machine comprising a vehicle having a frame, a vacuum drawing machine connected for movement with said vehicle having a housing and debris separating means and a hi-vacuum blower, transport means for moving said vehicle along a roadway, a vacuum casing located extending transversely of said vehicle immediately above the ground, first means supporting said vacuum casing on the ground, second means depending from said vacuum casing to near the ground to improve pick-up of debris by vacuum into said vacuum casing, a conduit to convey debris from said vacuum casing to said housing, a pair of transversely spaced downwardly inclined links interconnecting said frame and said vacuum casing, each said link having ball-and-socket joints at each end, and lifting means to elevate said vacuum casing between ground-engaging and raised positions, said second means comprising a front and back for said casing and flexible flaps attached to said front and back extending to near the ground, at least one said flap being hinged to said casing about a horizontal axis and adjustment means for pivoting said one said flap inwardly of said casing at varying angles.

2. A machine according to claim 1 in which said adjustment means comprises a vertical cylinder mounted on said casing having a rod and means articulately connecting said rod to said flap.

3. A street sweeping machine comprising a vehicle having a frame, a vacuum drawing machine connected for movement with said vehicle having a housing and debris separating means and a hi-vacuum blower, transport means for moving said vehicle along a roadway, a vacuum casing located extending transversely of said vehicle immediately above the ground, first means supporting said vacuum casing on the ground, second means depending from said vacuum casing to near the ground to improve pick-up of debris by vacuum into said vacuum casing, a conduit to convey debris from said vacuum casing to said housing, a pair of transversely spaced downwardly inclined links interconnecting said frame and said vacuum casing, each said link having ball-and-socket joints at each end, and lifting means to elevate said vacuum casing between ground-engaging and raised positions, said second means comprising a front and back for said casing and flexible flaps attached to said front and back extending to near the ground, a horizontal brush shaft supported by said vacuum casing, a brush on said brush shaft, and a motor to rotate said shaft, said brush being separated into two sections with a gap therebetween, a breaker blade in said gap, a horizontal blade shaft mounted on said casing on which said blade is fixed, a motor for rotating said blade shaft, an opening in said casing adjacent said gap, said conduit communicating with said opening, a housing connected to said casing and enclosing said breaker blade as it rotates, said housing having edges against which sticks inside said casing are forced by rotation of said breaker blade.

4. A machine according to claim 3 in which said blade shaft is parallel to and located above said brush shaft.

5. A street sweeping machine comprising a vehicle having a frame, a vacuum drawing machine connected for movement with said vehicle having a housing and debris separating means and a hi-vacuum blower, transport means for moving said vehicle along a roadway, a vacuum casing located extending transversely of said vehicle immediately above the ground, first means supporting said vacuum casing on the ground, second means depending from said vacuum casing to near the ground to improve pick-up of debris by vacuum into said vacuum casing, a conduit to convey debris from said vacuum casing to said housing, a pair of transversely spaced downwardly inclined links interconnecting said frame and said vacuum casing, each link having ball-and-socket joints at each end, and lifting means to elevate said vacuum casing between ground-engaging and raised positions, said second means comprising a front and back for said casing and flexible flaps attached to said front and back extending to near the ground, a curb casing extending transversely of and to one side of said vehicle immediately above the ground, swivel-mounted casters supporting said curb casing from said housing, a pair of transversely-spaced downwardly-inclined links interconnecting said frame and said curb casing, said means biasing said curb casing outward of said one side to engage a curb or the like, a shaft through said curb casing, a brush on said shaft, and a motor to rotate said shaft and in which said curb casing has adjustment screws in threaded engagement with said curb casing, and supports for said shaft relative to said curb casing to accommodate wear of said brush.

6. A street sweeping machine comprising a vehicle having a frame, a vacuum drawing machine connected for movement with said vehicle having a housing and debris separating means and a hi-vacuum blower, transport means for moving said vehicle along a roadway, a vacuum casing located extending transversely of said vehicle immediately above the ground, first means supporting said vacuum casing on the ground, second means depending from said vacuum casing to near the ground to improve pick-up of debris by vacuum into said vacuum casing, a conduit to convey debris from said vacuum casing to said housing, a pair of transversely spaced downwardly inclined links interconnecting said frame and said vacuum casing, each said link having ball-and-socket joints at each end, and lifting means to elevate said vacuum casing between ground-engaging and raised positions, said second means comprising a front and back for said casing and flexible flaps attached to said front and back extending to near the ground, a horizontal brush shaft supported by said vacuum casing, a brush on said brush shaft, and a motor to rotate said shaft, said casing, said brush shaft and said brush each being formed in two sections, said casing sections being hinged about a horizontal, longitudinal hinge, and means for raising or lowering one said casing section at an angle relative to the other said casing about said hinge to accommodate crowned streets and the like.

7. A street sweeping machine comprising a vehicle having a frame, a vacuum drawing machine connected for movement with said vehicle having a housing and debris separating means and a hi-vacuum blower, transport means for moving said vehicle along a roadway, a vacuum casing located extending transversely of said vehicle immediately above the ground, first means supporting said vacuum casing on the ground, second means depending from said vacuum casing to near the ground to improve pick-up of debris by vacuum into said vacuum casing, and a conduit to convey debris from said vacuum casing to said housing, said casing having a top formed with a first opening and which further comprises a detachable, interchangeable plate closing off said opening, said plate being formed with a second opening, and a duct connected to said opening, said conduit being detachably connected to said duct.

8. A machine according to claim 7 which further comprises a scoop attached to the underside of said plate extending down to near ground level and having a third opening near ground level and a brush mounted in said casing immediately ahead of said third opening and means to rotate said brush to lift debris from the ground into said third opening.

9. A machine according to claim 7 which further comprises a brush in said casing having two sections with a gap therebetween, a stick breaker blade in said gap, a horizontal blade shaft mounted on said plate on which said blade is fixed, a third opening in said plate adjacent said gap, a housing connected to said plate and enclosing said blade as it rotates, said housing having edges against which sticks inside said casing are forced by rotation of said blade and a motor mounted on said plate for rotating said shaft.

10. A street sweeping machine including means for breaking sticks and other large debris comprising a casing, first means supporting said casing above the ground, a horizontal brush shaft through said casing, a brush on said brush shaft, means for rotating said brush shaft, said brush being separated into two sections with a gap therebetween, a breaker blade in said gap, a horizontal blade shaft mounted on said casing on which said blade is fixed, means for rotating said blade shaft, said casing being formed with an opening above said gap, a housing having edges against which sticks inside said casing are forced by rotation of said blade, transport means to move said machine along a roadway, and suction means and a conduit interconnecting said suction means and said casing.

11. A machine according to claim 10 in which said blade shaft is parallel to and located above said brush shaft.

12. A machine according to claim 11 in which said shafts rotate in the same direction.

13. A machine according to claim 12 in which said brush shaft rotates to move the bottom of said brush in a direction opposite the direction of travel of said machine.

* * * * *